US005690145A

United States Patent [19]

Kuklinski et al.

[11] Patent Number: 5,690,145

[45] Date of Patent: Nov. 25, 1997

[54] FLUIDIC DEVICE CONTROLLED BY REMOTELY LOCATED ACOUSTIC ENERGY SOURCE

[75] Inventors: Robert Kuklinski, Portsmouth; Stuart C. Dickinson, Bristol, both of R.I.

[73] Assignee: The United States of America as represented by the Secretary of the Navy, Washington, D.C.

[21] Appl. No.: 695,840

[22] Filed: Aug. 5, 1996

[51] Int. Cl.[6] ..... F15C 1/04

[52] U.S. Cl. ..... 137/828; 181/0.5

[58] Field of Search ..... 137/828; 181/0.5

[56] References Cited

U.S. PATENT DOCUMENTS

| | | | |
|---|---|---|---|
| 3,144,037 | 8/1964 | Cargill et al. | 137/828 |
| 3,311,122 | 3/1967 | Gottron | 137/828 |
| 3,334,641 | 8/1967 | Bjornsen | 137/828 |
| 3,463,177 | 8/1969 | McMillan | 137/828 |
| 5,540,248 | 7/1996 | Drzewiecki et al. | 137/828 |

FOREIGN PATENT DOCUMENTS

| | | | |
|---|---|---|---|
| 590503 | 1/1978 | U.S.S.R. | 137/828 |

*Primary Examiner*—A. Michael Chambers

*Attorney, Agent, or Firm*—Michael J. McGowan; James M. Kasischke; Prithvi C. Lall

[57] ABSTRACT

A fluidic device is provided to control the path of a fluid. A control chamber has at least one window incorporated therein that permits acoustic waves impinging thereon to pass therethrough. An ultrasonic source is remotely located with respect to the control chamber and a coupling medium, such as water, air or an acoustic waveguide, acoustically couples the acoustic waves to the window(s).

18 Claims, 3 Drawing Sheets

FLUIDIC DEVICE CONTROLLED BY REMOTELY LOCATED ACOUSTIC ENERGY SOURCE

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to fluidic devices, and more particularly to a fluidic device that is controlled by wave energy from a remotely located wave energy source such as an acoustic or ultrasonic source.

(2) Description of the Prior Art

Fluidic devices are known in the art. The basic fluidic device consists of a power jet flowing into a control chamber where the path of the power jet is controlled by forces applied transversely to the power jet. The transverse forces are typically applied either in the form of a control jet of fluid pumped into the control chamber or in the form of (acoustic) wave energy applied to the power jet by means of transducers mounted in the control chamber. However, the use of fluid-based control jets requires additional plumbing which, because it generally involves piping that is small in diameter, is subject to clogging by fluid contaminants. While the use of acoustic transducers to control the power jet does not require additional plumbing, it does require the hard-wiring of an energy source to the transducers. Such wiring is subject to damage which, in severe environmental conditions, is difficult or impossible to repair.

SUMMARY OF THE INVENTION

Accordingly, it is an object of the present invention to provide an improved fluidic device.

Another object of the present invention is to provide a fluidic device that avoids the plumbing problems associated with using fluid-based control jets.

Still another object of the present invention is to provide a fluidic device that avoids the hard-wiring problems associated with using transducer-based control sources.

Other objects and advantages of the present invention will become more obvious hereinafter in the specification and drawings.

In accordance with the present invention, a fluidic device is provided to control the path of a fluid. A control chamber of the device transports the fluid and has at least one window incorporated therein that permits acoustic waves impinging thereon to pass therethrough. A source of acoustic, e.g., ultrasonic, waves is remotely located with respect to the control chamber. A coupling medium such as water, air or an acoustic waveguide acoustically couples the acoustic waves to the one or more windows.

BRIEF DESCRIPTION OF THE DRAWINGS

Other objects, features and advantages of the present invention will become apparent upon reference to the following description of the preferred embodiments and to the drawings, wherein.

DESCRIPTION OF THE PREFERRED EMBODIMENT

Figure 1:
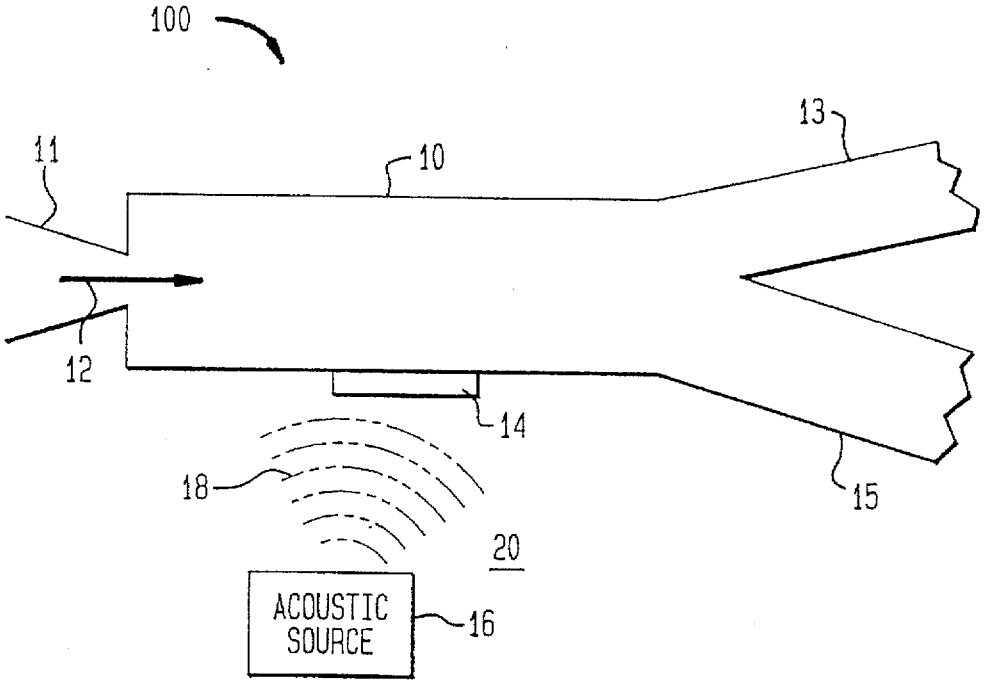
FIG. 1 is a plan view of one embodiment of an acoustically controlled fluidic device according to the present invention.

Referring now to the drawings, and more particularly to FIG. 1, one embodiment of an acoustically controlled fluidic device in accordance with the present invention is shown and referenced generally by numeral 100. For purposes of the present invention, the term acoustic will refer to frequencies in the ultrasonic spectrum. For purpose of illustration, fluidic device 100 is a simple switching type device. However, as will be understood by one of ordinary skill in the art, the novel principles of the present invention can be implemented to achieve a variety of fluidic devices, e.g., switches, bistable fluidic devices, etc.

In its simplest form, fluidic device 100 includes a control chamber 10 for carrying a fluid represented by arrow 12. Typically, fluid 12 exits a nozzle 11 as a power jet that empties into control chamber 10. Control chamber 10 has a window 14 in a wall thereof that permits the passage of acoustic waves therethrough. Window 14 is flush with the interior control chamber 10 so as not to introduce any unwanted disturbance in fluid 12.

For operation of a switch, control chamber 10 branches into upper channel 13 and lower channel 15. As with any standard fluidic "switch", the path of fluid 12 is controlled such that fluid 12 continues primarily into either upper channel 13 or lower channel 15. Remotely located with respect to control chamber 10 is an acoustic source 16 for generating acoustic, i.e., ultrasonic, waves 18 that are generally directed towards window 14. Waves 18 are transmitted through an acoustic coupling medium 20 from source 16 to window 14. As will be explained by way of examples below, acoustic coupling medium 20 is chosen to efficiently couple waves 18 from source 16 to window 14 where waves 18 pass therethrough into control chamber 10 for acting on fluid 12.

In operation, changes in frequency and power level of waves 18 vary the amount of force experienced by fluid 12. If waves 18 represent plane waves, a direct disturbance of fluid 12 is introduced. When waves 18 represent high-power ultrasonic waves, gas bubbles (not shown) are produced by cavitation in fluid 12. For example, if fluid 12 is water at atmospheric temperature and pressure conditions, waves 18 will cause such gas bubbles to form at a frequency on the order of 1 megahertz and at a power level on the order of 140 dB. Accordingly, acoustic source 16 can be a signal generator and transducer capable of generating these waves. When gas bubbles form, they define regions where a large amount of the ultrasonic energy imparted by waves 18 is absorbed. As the stream of gas bubbles rises in control chamber 10, it exerts a force on fluid 12 causing fluid 12 to move up to upper channel 13. Conversely, when waves 18 are not present, fluid 12 tends to follow the force of gravity into lower channel 15.

Figure 2:
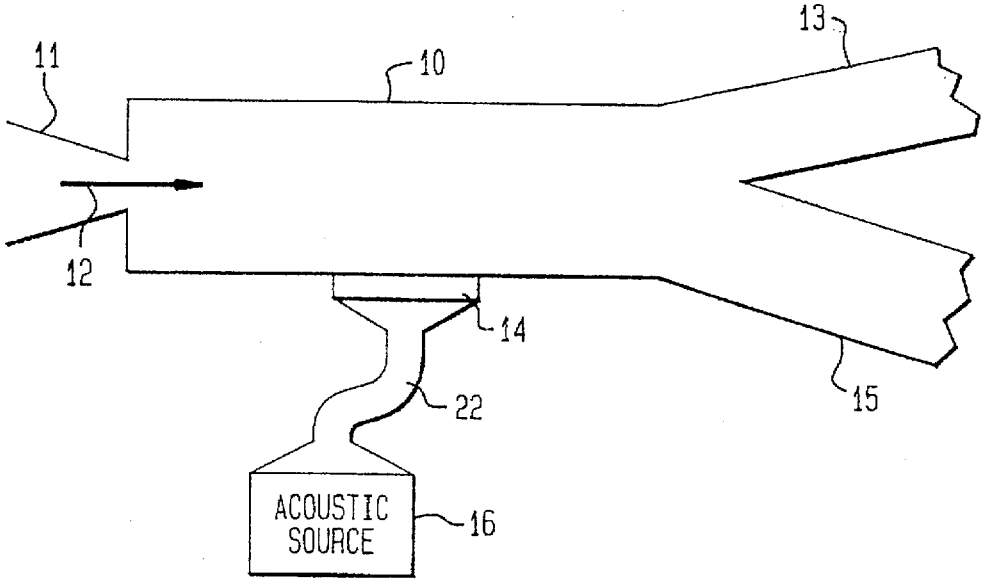
FIG. 2 is a plan view of another embodiment of the present invention.

As mentioned above, acoustic source 16 is remotely located with respect to control chamber 10. This has the advantage of not requiring any electronics to be located in the vicinity of control chamber 10. However, it is necessary to couple the waves 18 into control chamber 10. To do this, coupling medium 20 should efficiently couple waves 18 to window 14, and acoustic source 16 should provide a directed acoustic beam with minimal spread. For example, coupling medium 20 could be a fluid medium such as water or air. Another embodiment is shown in FIG. 2 where like elements are labeled with common reference numerals. In FIG. 2, the coupling medium could be implemented by means of a flexible acoustic wave guide 22 when construction or environmental conditions prohibit the use of a fluid coupling medium. Wave guide 22 can be implemented as a gas or air filled tube joined between acoustic source 16 and window 14. Once again, the electronics associated with acoustic source 16 can be remotely located with respect to control chamber 10 thereby simplifying the physical protection and electronic shielding of acoustic source 16.

Once waves 18 have reached window 14, their energy must be efficiently coupled and directed/focused into fluid 12 for controlling the path of fluid 12 as explained above. To do this, window 14 must allow the passage of waves 18 therethrough while directing waves 18 to a region within control chamber 10 where path control of fluid 12 can be achieved. Accordingly, window 14 is typically made from an acoustically transparent material such as rubber, polyurethane, or syntactic foam manufactured to closely match the acoustic impedance of fluid 12.

Figure 3A:
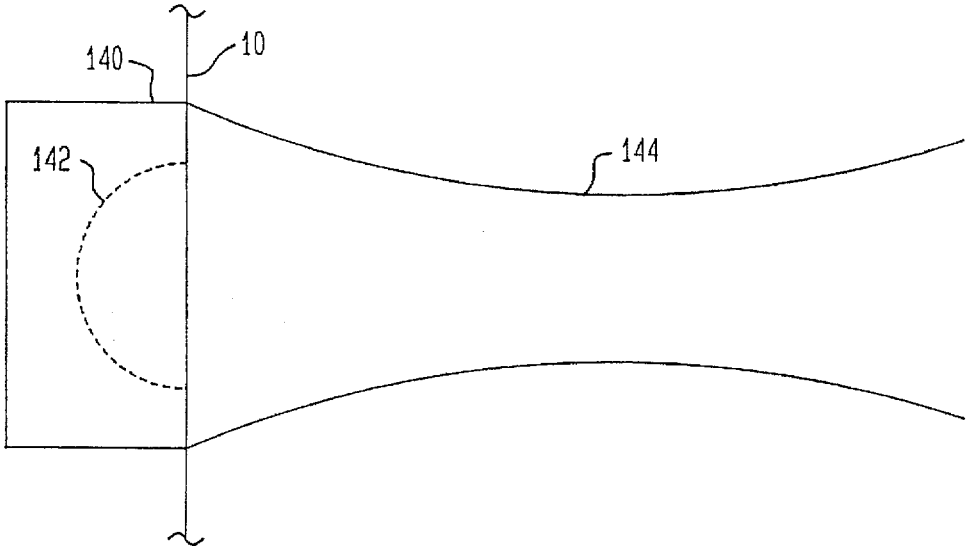
FIG. 3A is a cross-sectional view of one embodiment of an acoustic window/lens for focusing acoustic waves into the control chamber portion of the fluidic device.
Figure 3B:
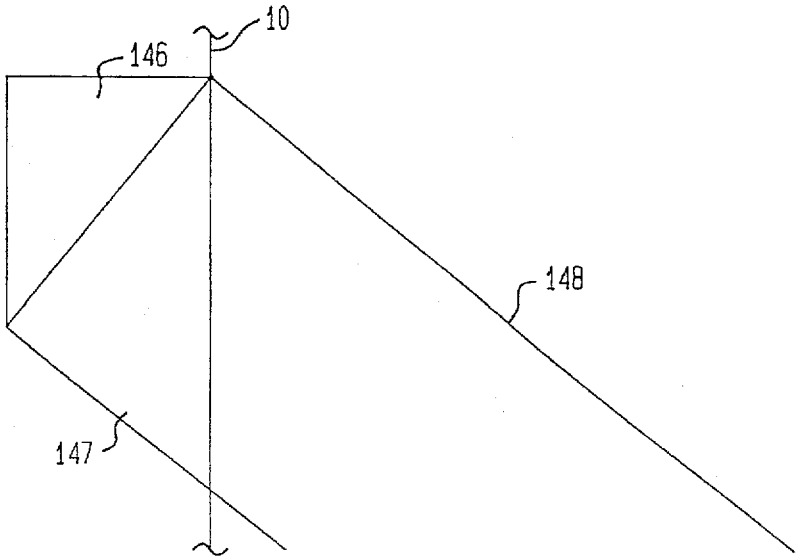
FIG. 3B is a cross-sectional view of another embodiment of an acoustic window/lens.

The geometry of window 14 can be shaped to focus waves 18 to a selected region within control chamber 10. Two examples of such shaping are depicted in the cross-sectional views of FIGS. 3A and 3B. In FIG. 3A, acoustic window or lens 140 is mounted in control chamber 10 and is "cupped" as indicated by dashed lines 142. Thus, waves 18 are directed by lens 140 into control chamber 10 as a focused beam 144. In FIG. 3B, acoustic lens 146 is angled and coupled with an acoustically transparent window 147 in order to direct waves 18 into control chamber 10 as angled beam 148.

The advantages of the present invention are numerous. The plumbing and hard wiring problems generally associated with fluidic devices are eliminated since the source of control energy can be remotely located with respect the fluid-carrying control chamber. Further, since the source of control energy can be remotely located, proper protection of the source is simplified. Thus, the present invention is easily adapted to a variety of situations.

Figure 4:
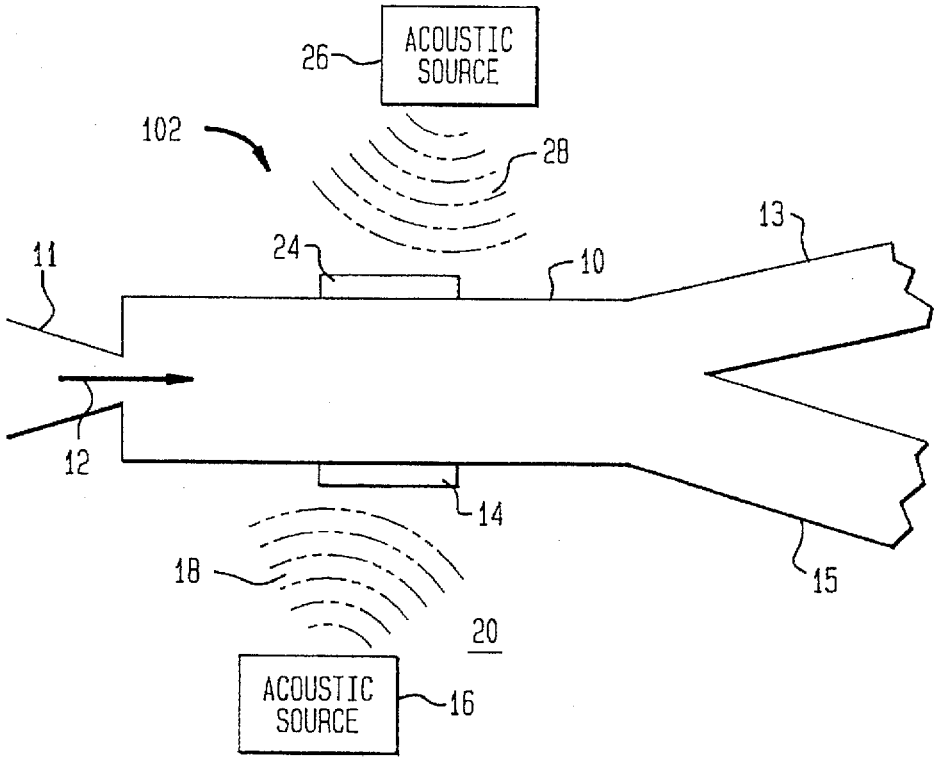
FIG. 4 is a plan view of a bistable fluidic device according to the present invention.

For example, the present invention could be extended to implement a bistable fluidic device 102 as shown in FIG. 4 where like reference numerals are used for common elements. Device 102 could incorporate window 24 (opposite window 14) and acoustic source 26 producing acoustic waves 28. In this way, active control of the path of fluid 12 can always be achieved depending on which acoustic source is activated.

Figure 5:
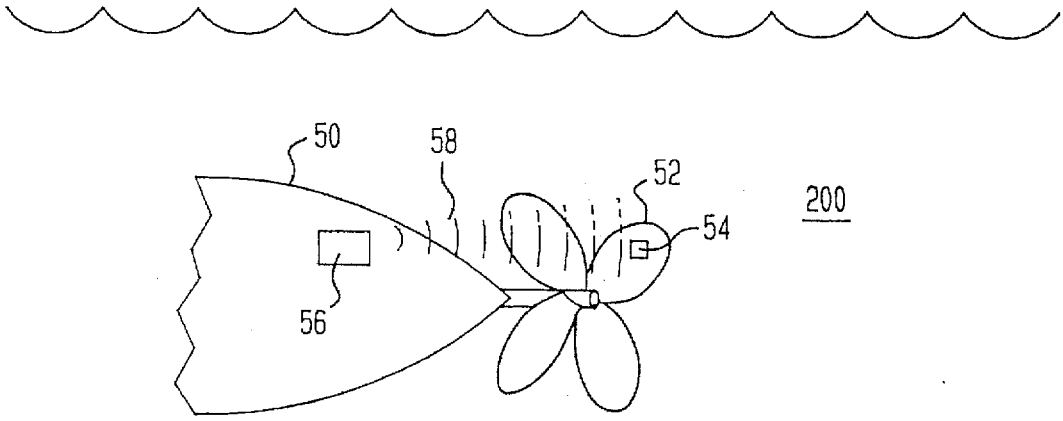
FIG. 5 is a perspective view of the after body of a submerged vehicle where the acoustic source of the present invention is mounted on the after body and the control chamber with acoustic window is mounted in a propeller blade of the vehicle.

The present invention also allows for relative movement between the acoustic source and the control fluid in its control chamber. In FIG. 5, the after body portion of submerged vehicle 50 is shown with its propeller 52 connected thereto. Utilizing the teachings of the present invention, acoustic source 56 is housed in after body 50 and directs acoustic waves 56 through the water 200 towards propeller 52. Mounted in one (or more) of the blades of propeller 52 is an acoustic window 54 through which waves 58 can pass to a control fluid (not shown) moving through a control chamber (not shown) as described above. Thus, waves 58 can be used to effect path control of the control fluid even though propeller 52 moves relative to source 54.

From the above description, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A fluidic device for controlling the path of a fluid, comprising:

a control chamber for transporting said fluid;

at least one window incorporated in said control chamber that permits acoustic waves impinging on said window to pass therethrough into said chamber;

a source for producing said acoustic waves, said source being remotely located with respect to said control chamber; and a coupling medium acoustically coupling said acoustic waves to said at least one window.

2. A fluidic device as in claim 1 further comprising a converging nozzle coupled to an upstream portion of said control chamber.

3. A fluidic device as in claim 1 wherein said at least one window is flush with the interior of said control chamber.

4. A fluidic device as in claim 1 wherein said coupling medium is an acoustic waveguide.

5. A fluidic device as in claim 1 wherein said coupling medium is another fluid.

6. A fluidic device as in claim 5 wherein said another fluid is water.

7. A fluidic device as in claim 5 wherein said another fluid is air.

8. A fluidic device as in claim 1 wherein each said at least one window is shaped to focus said acoustic waves at a selected region within said control chamber.

9. A fluidic device as in claim 1 wherein said window is in motion relative to said source, and said coupling medium is the environmental medium located between said source and said window.

10. A fluidic device for controlling the path of a control fluid, comprising:

a nozzle for receiving said control fluid and producing a power jet;

a plurality of output channels downstream of said nozzle;

a control chamber coupling said nozzle to said plurality of output channels, wherein said control chamber receives said power jet;

at least one acoustic window forming a portion of said control chamber and having an acoustic impedance that is approximately equal to the acoustic impedance of said control fluid;

at least one source of acoustic energy remotely located with respect to said control chamber for directing acoustic waves toward said at least one acoustic window; and fluid medium separating said at least one acoustic window and said at least one source of acoustic energy.

11. A fluidic device as in claim 10 wherein said control fluid and said fluid medium are the same kind of fluid.

12. A fluidic device as in claim 10 wherein said fluid medium is water.

13. A fluidic device as in claim 12 wherein said window is in motion relative to said at least one source of acoustic energy.

14. A fluidic device as in claim 10 wherein said fluid medium is air.

15. A fluidic device as in claim 10 wherein each of said at least one acoustic window is flush with an interior surface of said control chamber.

16. A device as in claim 10 wherein each of said at least one acoustic window is shaped to focus acoustic energy impinging thereon at a selected region within said control chamber.

17. A device as in claim 10 wherein said acoustic window further comprises an angled lens angling said acoustic waves into said control chamber.

18. A fluidic device for controlling the path of a control fluid, comprising:

a nozzle for receiving said control fluid and producing a power jet;

a plurality of vertically oriented output channels downstream of said nozzle, said nozzle being directed toward a default output channel;

a control chamber coupling said nozzle to said plurality of output channels, wherein said control chamber receives said power jet;

at least one acoustic window forming a portion of said control chamber and having an acoustic impedance that is approximately equal to the acoustic impedance of said control fluid;

at least one source of acoustic energy remotely located with respect to said control chamber for directing acoustic waves toward said at least one acoustic window, said acoustic energy source capable of causing cavitation in said control fluid, said cavitation generating bubbles having buoyancy which induces said power jet to one said output channel positioned vertically above said default output channel; and a fluid medium separating said at least one acoustic window and said at least one source of acoustic energy.

* * * * *